United States Patent [19]

Anschel et al.

[11] 3,963,841

[45] June 15, 1976

[54] CATALYTIC SURFACE PREPARATION FOR ELECTROLESS PLATING

[75] Inventors: Morris Anschel, Carmel; Stephen Anthony Shear, Greenfield Park, both of N.Y.

[73] Assignee: International Business Machines Corporation, Armonk, N.Y.

[22] Filed: Jan. 6, 1975

[21] Appl. No.: 539,206

[52] U.S. Cl. ..... 427/304; 427/305; 427/306; 427/437; 427/438; 106/1

[51] Int. Cl.[2] ..... C23C 3/02

[58] Field of Search ..... 427/304, 305, 306, 98, 427/92; 106/1, 286

[56] References Cited

UNITED STATES PATENTS 3,460,952 8/1969 Saubestre et al. ..... 106/1

3,682,671 8/1972 Zeblisky ..... 106/286

*Primary Examiner*—Ralph S. Kendall

*Attorney, Agent, or Firm*—David M. Bunnell

[57] ABSTRACT

A catalyst solution for making surfaces receptive to the deposition of adherent electroless metal layers includes a complex of a precious metal salt with dimethyl sulfoxide such as, for example, $Pd\ Cl_2 \cdot 2(CH_3)_2\ SO$ together with a group IV metal salt such as, for example, stannous chloride. A process for rendering surfaces, such as glass, receptive to adherent electroless metal layers using the catalyst solution is also provided.

13 Claims, No Drawings

CATALYTIC SURFACE PREPARATION FOR ELECTROLESS PLATING

BACKGROUND OF THE INVENTION

This invention relates generally to plating and more particularly to the catalytic surface preparation of substrates prior to electroless metal plating.

In the electroless plating of metal films onto the surfaces of various substrates which are non-conductive, it is conventional to treat the surface to be plated to activate it so that a layer of metal can be deposited by chemical deposition. The catalytic treatment acts to catalyze and/or accelerate the depositing of the metal film on the surface and causes the film to form a continuous and adherent layer.

In the past, various sensitizing compositions and processes have been employed. One well known technique is to utilize a plurality of baths in which the substrate is first immersed in a stannous chloride solution followed by immersion in an acidic palladium chloride solution to form an activating deposit of palladium on the substrate. Single sensitizing baths of colloidal dispersions of palladium and tin as described, for example, in U.S. Pat. No. 3,011,920; or soluble complexes of palladium-tin-chloride prepared by heating aqueous acid mixtures of the metal salts as is described, for example, in U.S. Pat. No. 3,682,671 have also been employed.

It has been found that it is difficult to form adherent coatings on certain substrates, particularly glasses.

BRIEF SUMMARY OF THE INVENTION

In accordance with this invention, there is provided a catalyst solution for electroless metal deposition comprising a complex of a salt of precious metal of the fifth or sixth periods of group VIII of the periodic table and dimethyl sulfoxide together with a metal salt of group IV of the periodic table which is capable of reducing the precious metal salt.

Also provided is a process for forming adherent metal layers on surfaces using the catalyst solution of the invention by contacting the surface to be plated with the catalyst solution and then contacting the surface with an electroless metal plating solution to form a layer of the metal on the surface. It has also been found that the adhesion can be improved by baking the surface after the catalyst has been applied. Additional thicknesses of metal can then be formed by placing the electrolessly plated metal substrate in an electroplating bath.

DETAILED DESCRIPTION

The catalyst solution of the invention can be used to impart surface activity for subsequent electroless or chemical plating on both metallic and nonmetallic surfaces. For example, coatings can be formed on metals such as stainless steel, chromium, aluminum, molybdenum, vanadium, tungsten, copper, nickel, silver, and gold. It is particularly useful for forming adherent metal layers on nonmetallic surfaces such as silicate and nonsilicate glasses, for example, quartz, soda lime float or plate glass, borosilicate, lead borate, aluminosilicate, alumina ceramic, and tin oxide. The catalyst solution is also useful in forming metal layers on polymers such as epoxy resins, polyvinyl chloride, polyethylene, polypropylene, polyethylene oxide terephthalate, fluorine containing polymers such as are sold under the trade name, Teflon, and other natural and synthetic polymers and interpolymers which are not significantly attacked by dimethyl sulfoxide and the organic solvents which are employed in the catalyst solution.

The solutions have been found to be particularly useful in the plating of conductor lines onto glass substrates used in forming display devices. It has been found that prior art electroless metal plating catalytic substrate preparation processes have been unsuitable for forming adherent electrolessly plated metal layers on the glass substrates.

The catalyst solutions of the invention comprise a complex between a precious metal salt of a metal of the fifth and sixth periods of group VIII of the periodic table, such as palladium, platinum, ruthenium, and osmium, and dimethyl sulfoxide together with a metal salt of group IV of the periodic table which is capable of reducing the precious metal salt to its elemental form, such as, for example, stannous tin, titanium and germanium. The complex and the group IV metal salt are contained in an organic solvent, for example; ketones such as acetone and methyl ethyl ketone; alcohols such as methanol ethanol; ethers such as diethyl ether; ester, such as ethyl and methyl acetate; and mixtures thereof. The anion portion of the Group IV and VIII metal salts are preferably chlorides, bromides, fluorides, iodides, nitrates, and sulphates.

The dimethyl sulfoxide is advantageously used in sufficient excess so that the complex is completely soluble in the catalyst solution. This has been found to provide a more adherent seed coating on the substrate. Amounts of about 5 to 200 mil of dimethyl sulfoxide per gram of precious metal salt can be employed and although greater amounts could be used they are unnecessary.

The Group VIII and Group IV salts are used in about a 1:1 mole ratio or at least a stoichiometric amount of the group IV salt. An excess of group IV salt is not harmful, but, for most purposes has been found to be unnecessary.

The catalyst solutions are prepared by adding the precious metal to an excess of dimethyl sulfoxide (DMSO) to form, for example, in the case of Pd $Cl_2$ a yellow orange solution of the complex Pd $Cl_2 \cdot 2(CH_3)_2SO$. The group IV metal salt, such as for example, stannous chloride, contained in an organic solvent, such as acetone, is then added to complete the catalyst solution. A clear brown solution is formed.

The activation process involves contacting the surface of the substrate to be plated in a conventional manner such as by immersing the substrate in the catalyst solution. The time of immersion has not been found to be particularly critical with times of from about 5 minutes to about 2 hours having been successfully employed. The optimum time for any particular application is easily determinded by one skilled in the art.

The concentration of precious metal ion in the catalyst solution is also not particularly critical can range, for example, from about 0.001 to 10 grams per liter with amounts of about 1 to 2 grams per liter being preferred.

After the immersion of the substrate in the catalyst solution, the substrate is removed from the solution, rinsed free of excess solution and air dried. The substrate is then contacted with the electroless metal formulation. Such electroless metal formulations are conventional and include baths which will deposit arsenic, chromium, cobalt, cobalt-nickel, copper, gold, iron, nickel and palladium. The baths are usually in the form of basic solutions of a salt of the metal to be deposited together with stabilizing agents and a reducing agent such as sodium hypophosphite.

It has been found that the adherence of the electrolessly plated layer to glass is significantly improved by post baking of the substrate surface following catalyst treatment at elevated temperatures. For example, by heating the substrate for from about 5 minutes to 2 hours in the range of about 150° to 200°C.

Following the electroless plating step, the substrate can be electroplated with the same or a different metal by conventional techniques in order to build up the thickness of the metal coating.

The invention is further illustrated by, but is not intended to be limited to the following examples wherein parts are parts by weight unless otherwise indicated.

EXAMPLE 1

A soda lime glass plate was cleaned with a surface active agent solution for 90 seconds and rinsed with tap water. The plate was next immersed in a oxidizing cleaning solution of 8 parts nitric acid, 2 parts hydrofluoric acid and 30 parts of deionized water for 10 seconds followed by rinsing successively in hot tap water, deionized water, and a 1:1 acetoneethyl alcohol solution. The glass plate was air dried. The plate was submerged in a catalyst formulation prepared by dissolving 1 gram of palladium chloride in 100 milliliters of dimethyl sulfoxide to which is added 1 gram of Sn $Cl_2 \cdot 2H_2O$ in 500 milliliters of acetone. The plate was submerged for a period of 1.5 hours under ambient conditions followed by rinses in hot tap water and deionized water and air drying. The washing is necessary to remove any residual catalyst solution from the substrate. The plate was baked at 177°C for 1.5 hours and then was cooled to about 90°C and immersed in boiling deionized water for about 2 minutes. The plate was then immersed for 15 seconds in an electroless nickel metal plating formulation made by mixing a solution which is prepared by dissolving 20 grams of nickel sulphate and 750 milliliters of water followed by adding 20 grams of sodium citrate and 20 grams of ammonium hydroxide and adding to this solution a solution of 20 grams of sodium hypophosphite and 250 milliliters of water. After immersion of the plate in the electroless plating formulation, it was rinsed in deionized water and then immersed in a conventional copper sulphate plating bath for 12 minutes. The plate was then rinsed in boiling deionized water for 2 minutes followed by a second immersion in the electroless nickel bath for 15 seconds. The resultant metal had a first nickel layer about 2300 A thick, a copper layer about 23000 A thick and an upper nickel layer about 2400 A thick. The coating was firmly adhered to the glass as it remained intact on the glass when a strip of pressure sensitive transparent adhesive tape was placed in contact with the layer and then torn off.

EXAMPLE 2

In order to illustrate the advantages of the invention over a prior art activation process, a glass plate was cleaned in accordance with the process of example 1. The plate was immersed in a solution of stannous chloride (40 grams per liter in aqueous HCl) with agitation, rinsed and then immersed in a second solution of palladium chloride (1 gram per liter in aqueous HCl). The plate was then immersed successively as in example 1 in the nickel electroless plating bath, the copper electroplating bath, and the nickel electroless plating bath. The resultant metal layer did not adhere to the glass surface but was stripped off by the tape test.

EXAMPLE 3

The process of example 1 was repeated with the following three substrates; alumina silicate glass, soda lime glass, and glass filled epoxy. The immersion time in the catalyst solution was 5 minutes rather than 1.5 hours. The remainder of the process steps were carried out as is described in example 1. It was found that the shorter dip time is sufficient to obtain a firmly adhered metal layer of nickel-copper-nickel on the surface of each of the three substrates.

EXAMPLE 4

A clean soda lime glass substrate was immersed in a catalyst formulation prepared by dissolving chloroplatinic acid, $H_2PtCl_6 \cdot 6H_2O$, 1 gram, in 100 milliliters of dimethyl sulfoxide to which was added 1 gram of stannous chloride in 500 milliliters of acetone. The immersion time was 15 minutes. The plate was rinsed in hot tap water followed by deionized water and air dried. The plate was immersed in the electroless nickel bath as described in example 1. An adherent nickel coating was produced on the glass plate.

EXAMPLE 5

A clean soda lime glass plate was submerged in a catalyst formulation which is prepared by mixing a solid $PdCl_2 \cdot 2$ dimethyl sulfoxide complex contained in 250 milliliters of acetone with 1 gram of stannous chloride contained in 250 milliliters of acetone. It was noted that the complex was not completely soluble in the acetone. The solid complex was obtained by adding 1 gram of $PdCl_2$ to excess DMSo and then separating the solid complex which formed from the excess DMSO. The plate was submerged for a period of 5 minutes after which it was washed in hot tap water followed by a deionized water rinse. Some of the seeding agent appeared to be washed off in the hot water because it was not firmly adhered. The plate was placed in the nickel electroless metal formulation described in example 1 and a nickel coating was formed which had inferior properties when compared to the coatings produced when the catalyst solution with an excess DMSO is used as in example 1. The inferior result is believed to be due to the limited solubility of the complex in acetone alone. This example shows that, although the solid complex of palladium chloride and dimethyl sulfoxide activates the glass surface for plating in the absence of excess dimethyl sulfoxide, at least a sufficient excess of dimethyl sulfoxide or an inert solvent which will substantially completely solublize the complex is advantageously employed.

EXAMPLE 6

Other catalyst formulations can be prepared by substituting for the palladium chloride either $RuCl_3$, $PtCl_2$ or $Pd(NO_3)_2$ and adding to the metal salt-dimethyl sulfoxide complex in about 100 mils of DMSO, at least a stoichiometric amount of either, stannous chloride, titanium chloride or germanium chloride contained in about 500 milliliters of acetone.

EXAMPLE 7

Adherent electrolessly plated nickel layers on polyvinyl chloride, polytetrofluoroethylene, and polyethylene surfaces were formed by the process of example 1. The plastics are cleaned by a mild detergent solution in place of the cleaning process described in example 1 followed by submerging the plastic in the catalyst formulation.

EXAMPLE 8

The process of example 1 was repeated to plate electroless copper onto a clean soda lime glass plate using in place of the nickel bath a conventional electroless copper plating bath comprising copper sulfate, formaldehyde, sodium carbonate, rochelle-salt, nickel chloride, and sodium hydroxide at a Ph of about 9.

While the invention has been particularly shown and described with reference to preferred embodiments thereof, it will be understood by those skilled in the art the various changes in form and details may be made therein without departing from the spirit and scope of the invention.

We claim:

1. A catalyst solution for making surfaces receptive to electroless deposition of adherent metal layers consisting essentially of:

a complex of a salt of a precious metal of period 5 and 6 of group VIII of the periodic table with dimethyl sulfoxide; at least a stoichiometric amount based on the group VIII salt of a group IV metal salt capable of reducing the precious metal ion to an elemental form, the group IV metal being selected from the group consisting of tin, titanium and germanium; and an organic solvent.

2. The catalyst solution of claim 1 in which the precious metal salt is palladium chloride.

3. The catalyst solution of claim 1 in which the precious metal salt is palladium nitrate.

4. The catalyst solution of claim 1 in which the precious metal salt is chloroplatinic acid.

5. The catalyst solution of claim 1 in which the group IV salt is a stannous salt.

6. The catalyst solution of claim 5 in which the stannous salt is stannous chloride.

7. The catalyst solution of claim 1 in which a sufficient excess of dimethyl sulfoxide to solublize the complex is present in the catalyst solution.

8. The catalyst solution according to claim 1 in which the precious metal salt is present in an amount of from about 0.01 to 10 grams per liter of catalyst solution.

9. A process for electrolessly plating a metal onto a substrate comprising:

contacting the substrate with a catalyst solution consisting essentially of a complex of a salt of a precious metal of period 5 and 6 of group VIII of the periodic table with dimethyl sulfoxide together with a group IV metal salt capable of reducing the precious metal ion to an elemental form contained in an organic solvent; said group IV metal being selected from the group consisting of tin, titanium and germanium; washing the substrate; and contacting the substrate with an electroless metal plating bath to form an adherent layer of metal on the substrate.

10. The process of claim 8 including the step of baking the substrate at a temperature of from about 150° to 200°C after washing the substrate and prior to immersing it in the electroless plating bath.

11. The process of claim 10 wherein the substrate is a glass.

12. The process of claim 9 in which a sufficient excess of dimethyl sulfoxide to solublize the complex is present in the catalyst solution.

13. The process of claim 12 in which the complex is $PdCl_2 \cdot 2(CH_3)_2SO$.

* * * * *